United States Patent [19]

Sudo et al.

[11] Patent Number: 4,933,598

[45] Date of Patent: Jun. 12, 1990

[54] CATHODE-RAY TUBE WITH INTERNAL INSULATED ELECTRICAL CONDUCTORS

[75] Inventors: Masayuki Sudo, Kanagawa; Tomohisa Uba; Yasunobu Amano, both of Tokyo; Kazuo Omae, Saitama; Akira Nakayama, Tokyo; Yoshiro Ishikawa, Kanagawa; Ichiro Iwaki, Tokyo, all of Japan

[73] Assignee: Sony Corporation, Tokyo, Japan

[21] Appl. No.: 439,004

[22] Filed: Nov. 21, 1989

Related U.S. Application Data

[63] Continuation of Ser. No. 314,255, Feb. 22, 1989, abandoned, which is a continuation of Ser. No. 138,446, Dec. 24, 1987, abandoned.

[30] Foreign Application Priority Data

| | | | |
|---|---|---|---|
| Dec. 27, 1986 | [JP] | Japan | 61-309739 |
| Dec. 27, 1986 | [JP] | Japan | 61-200701 |
| Dec. 27, 1986 | [JP] | Japan | 61-200702 |

[51] Int. Cl.[5] ..... H01J 29/92; H01J 29/62

[52] U.S. Cl. ..... 343/477 HC; 313/432; 313/439; 313/412; 313/413

[58] Field of Search ..... 313/477 HC, 477 R, 432, 313/439, 412, 413

[56] References Cited

U.S. PATENT DOCUMENTS

| | | | |
|---|---|---|---|
| 3,626,232 | 12/1971 | Ohgoshi et al. | 313/477 X |
| 4,742,267 | 5/1988 | Francis et al. | 313/477 HC |

FOREIGN PATENT DOCUMENTS

| | | | |
|---|---|---|---|
| 452650 | 8/1936 | United Kingdom | 313/432 |
| 1205856 | 9/1970 | United Kingdom . | |
| 1217240 | 12/1970 | United Kingdom . | |
| 1246740 | 9/1971 | United Kingdom . | |
| 1406523 | 9/1975 | United Kingdom . | |
| 2088624 | 6/1982 | United Kingdom | 313/389 |

*Primary Examiner*—Palmer C. DeMeo

*Attorney, Agent, or Firm*—Hill, Van Santen, Steadman & Simpson

[57] ABSTRACT

A cathode-ray tube in which outer convergence plates as constituents of the convergence plate assembly in the electron gun are supplied with individual voltages so that the horizontal misconvergence at the center portion and at the peripheral portions of the screen are positively corrected and in the arrangement the anode button is provided with a plurality of voltage supply pins. Further, the end portions of the two lead wires which are introduced form the anode button are opened outwardly so that the lead wires are prevented from coming in contact with the bead glass.

2 Claims, 9 Drawing Sheets

CATHODE-RAY TUBE WITH INTERNAL INSULATED ELECTRICAL CONDUCTORS

This is a continuation of application Ser. No. 314,255, filed 2/23/89, and now abandoned, which is a continuation of Ser. No. 138,446, filed 12/12/87, and now abandoned.

BACKGROUND OF THE INVENTION

1. Field of the Invention

The present invention relates to a cathode-ray tube provided with an electron gun having convergence plates.

2. Description of the Prior Art

The electron gun of the cathode-ray tube of the TRINITRON (a tradename) type is a so-called "one gun three beam" single electron gun, which is characterized in that three electron beams which are emitted from its three cathodes are diverged after the beams cross at a point in the center of the principal lens and these three electron beams are then converged again on the screen by action of convergence means. The convergence means, specifically is constructed of four convergence plates which consist of a pair of inner convergence plates and a pair of outer convergence plates. The inner convergence plates are supplied with an anode voltage HV from a voltage supply means disposed on the tube wall at the funnel portion of the cathode-ray tube and the pair of outer convergence plates are supplied with an equal convergence voltage CV which is lower than the anode voltage. Adjustment of the convergence is performed by changing the D.C. voltage CV which is supplied to the outer convergence plates so that deflection of the R (red) and the B (blue) beams which are located at both sides of the G (green) beam may be changed.

The convergence is thus adjusted by changing the voltage CV which is supplied to the convergence plates. However, even if the convergence is adjusted so that the G beam and R beam converge at the center of the screen, sometimes the B beam will not converge at the center of the screen and so-called horizontal misconvergence is produced, as shown in FIG. 4 due to errors in assembly of the electron gun or the like. Conventionally, the horizontal misconvergence has been corrected by means such as a six-pole magnet 61*a*–61*f* as shown in FIG. 5. Although the convergence has thereby been achieved, still there has been such a problem that the form of the beam spots 62R, 62G, and 62B are distorted as shown in FIG. 6 due to the influence of the magnetic field. This problem becomes more severe as the resolution of the cathode-ray tubes have been enhanced.

Convergence is also achieved at peripheral portions of the screen by action of the deflection yoke (DY), but, in reality, asymmetric misconvergence sometimes occurs in which the B beam deviates in the horizontal direction when the R and G beams are converged as shown in FIG. 3 due to errors in assembly of the deflection yokes, positioning errors of the electron gun when it is enclosed in the neck portion, and installation errors of the deflection yokes when installed in the tube. So far, when the B and R beams are symmetrically deviated with respect to the G beam which is in between, adjustment has been achieved by dynamically applying to the outer convergence plates a common voltage having a parabolic waveform. However, in the prior art, it has not been possible to correct the misconvergence which occurs asymmetrically in the horizontal direction at both end portions on the X axis of the screen and at the four corners of the screen.

SUMMARY OF THE INVENTION

It is accordingly an object of the present invention to provide a cathode-ray tube in which the above mentioned problems are solved.

Another object of the present invention is to provide a anode button for use in cathode-ray tubes for solving the above mentioned problems.

A further object of the present invention is to provide a cathode-ray tube which solves the problem of the above mentioned misconvergence and more particularly, to provide supply means which furnish convergence voltage for achieving this object.

In the present invention, a cathode-ray tube is provided with an electron gun which has inner convergence plates 8*a*, 8*b* to which are applied an anode voltage HV and outer convergence plates 8*c*, 8*d* to which are applied a convergence voltage CV, and wherein the outer convergence plates 8*c*, 8*d* for deflecting the beams 9R and 9B are located at both sides of the central beam 9G and are arranged so as to be individually provided with their respective convergence voltages CV.

In the above arrangement, an anode button 12 is provided which has two voltage supply pins 15*a*, 15*b* which correspond to the outer convergence plates 8*c*, 8*d*.

Further, in the above arrangement, conductive pipes 33*a*, 33*b* with two lead wires 16*a*, 16*b* disposed therein are introduced from the anode button 12 so as to supply voltage to the outer convergence plates 8*c*, 8*d* and the pipes are formed such that their end portions 35*a*, 35*b* open out at least as wide as the width of the bead glass 36.

Although the beam deflection effect is actually produced by both the inner convergence plates 8*a*, 8*b* and the outer convergence plates 8*c*, 8*d*, the convergence plates for achieving the above described deflection are defined herein as the outer convergence plates 8*c*, 8*d*.

According to the present invention, since the outer convergence plates 8*c*, 8*d* are individually supplied with voltages, even if there are variations such as assembly errors of the electron gun 6, positioning errors of the electron gun 6 when it is enclosed in the tube, assembly errors of the deflection yokes, and installation errors when installing the deflection yokes into the tube, positive correction of the misconvergence in the horizontal direction at the center of the screen and at the periphery of the screen becomes possible due to means of individual adjustments of the R beam 9R and the B beam 9B. Since there is no need for using six-pole magnets for correction of the horizontal misconvergence, the distortion in the spot form which is experienced in the prior art can be eliminated.

If it is attempted to supply the outer convergence plates 8*c*, 8*d* with individual voltages according to the present invention but by means of the prior art anode button (refer to FIG. 11), two such buttons must be fitted to the tube, and therefore, the design of the funnel must be changed, and difficulties such as electrical leakage occurs since high voltage lead wires must be laid along the periphery of the cathode-ray tube 1. On the contrary, such difficulties can be overcome by the use of the anode button 12 according to the present invention, and yet, since only one anode button 12 is required, the process for embedding the anode button 12 is unchanged and the length of the lead wires 16*a*, 16*b* can be the same as before.

According to the present invention, conductive pipes 33*a*, 33*b* with two lead wires 16*a*, 16*b* disposed therein are introduced from the anode button 12 so as to supply individual voltages to the outer convergence plates 8*c*, 8*d* and have their end portions 35*a*, 35*b* opened out at least as wide as the width of the bead glass 36, and therefore, the problem caused by the bead glass 36 coming in contact with the end portions 35*a*, 35*b* of the conductive pipes 33*a*, 33*b*, which is the problem of so-called "push up", is solved. Incidentally, if such "push up" of the conductive pipes 33*a*, 33*b* by the bead glass 36 is caused, the conductive pipes 33*a*, 33*b* may be bent upwardly and the electron beam may be disturbed.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

DESCRIPTION OF THE PREFERRED EMBODIMENTS

An embodiment of the present invention will be described below with reference to the accompanying drawings.

Figure 1:
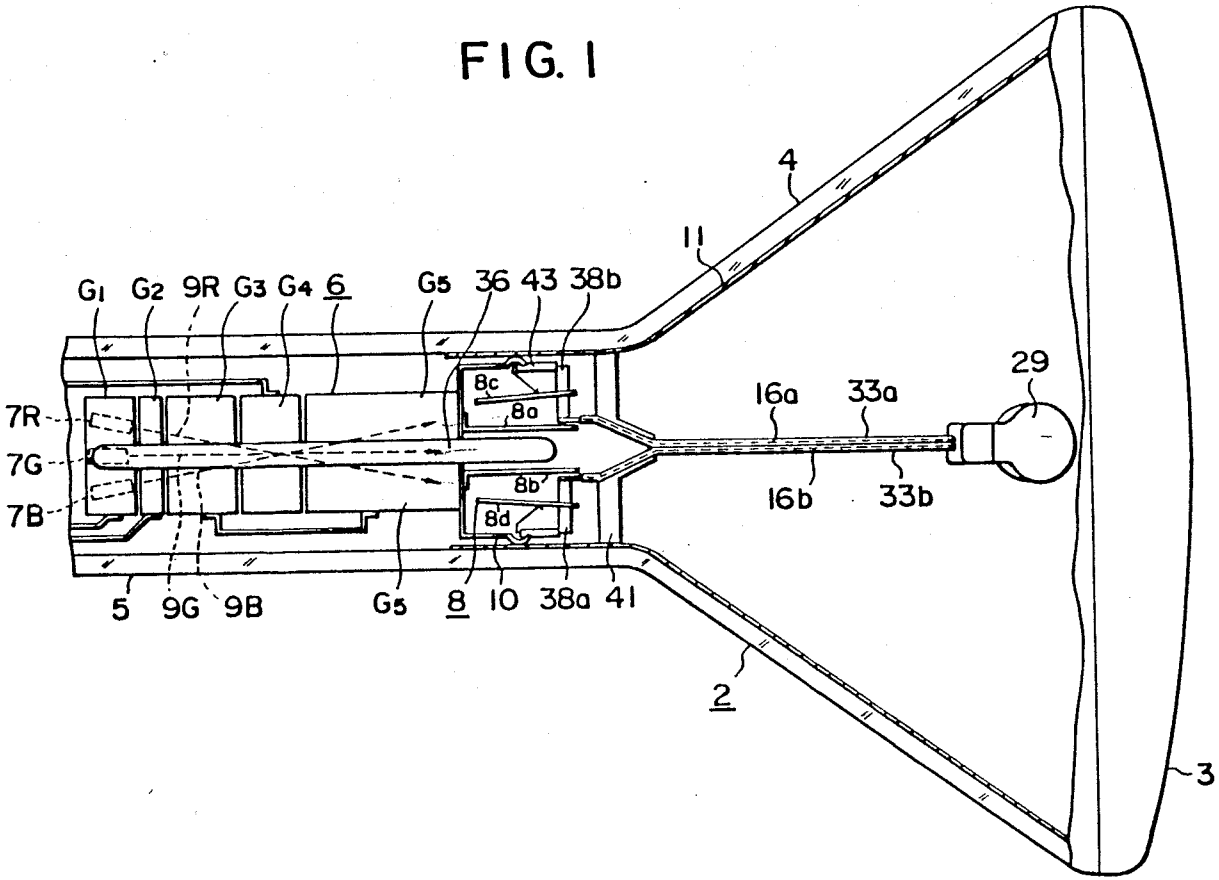
FIG. 1 is a sectional view of an embodiment of the invention.
Figure 2:
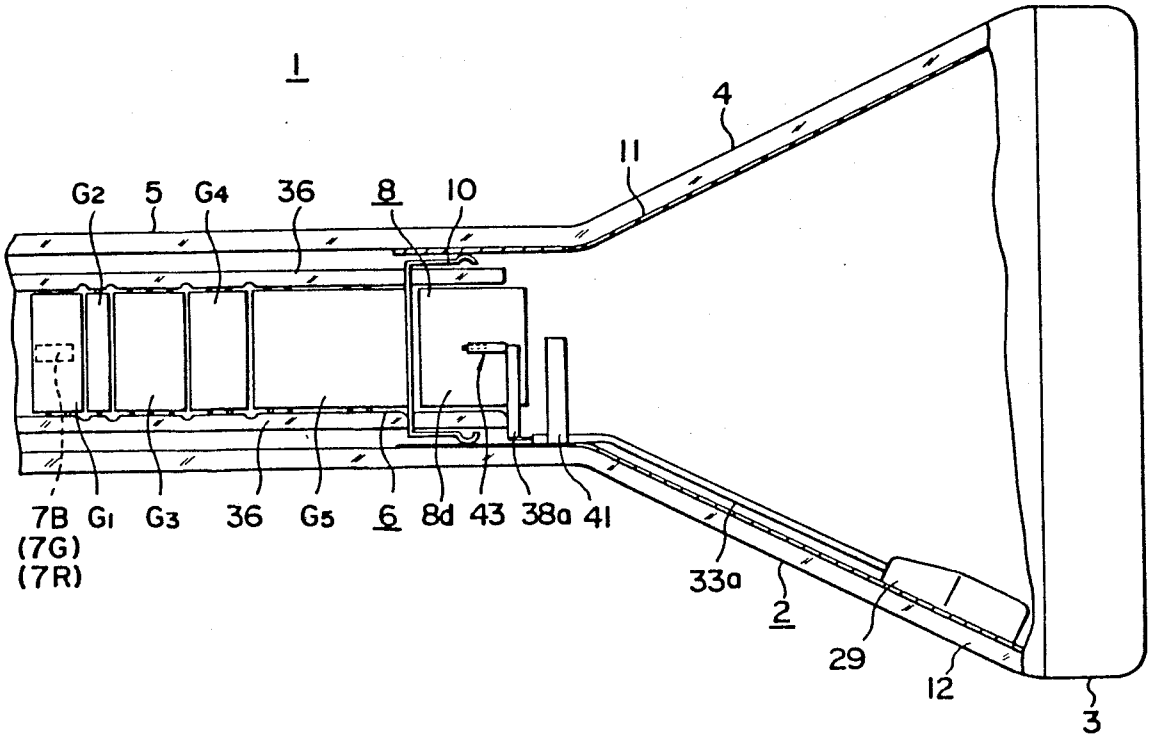
FIG. 2 is a sectional view of an embodiment.
Figure 3:
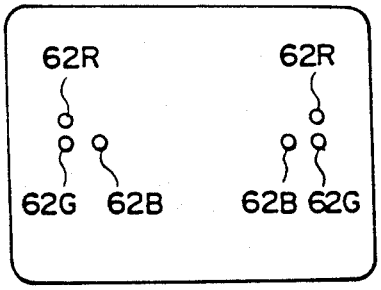
FIG. 3 is a drawing for showing misconvergence.
Figure 4:
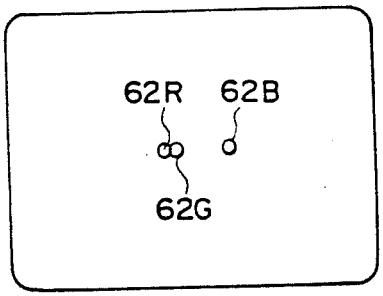
FIG. 4 is a drawing for showing misconvergence.
Figure 5:
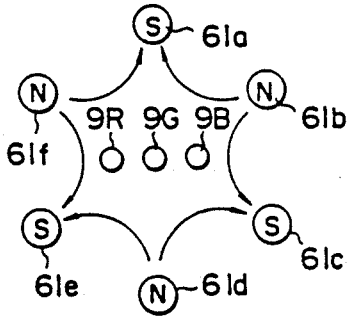
FIG. 5 is a drawing showing a correction means.
Figure 6:
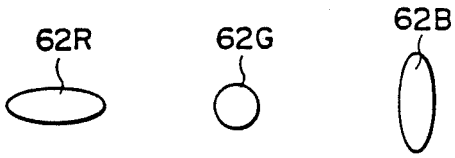
FIG. 6 is a drawing showing distortion of the shape of spot.
Figure 7:
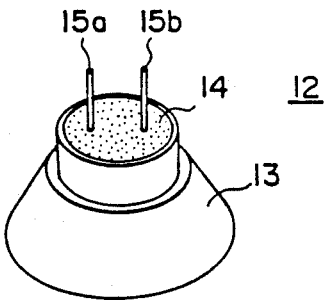
FIG. 7 is a perspective view of an anode button.
Figure 8:
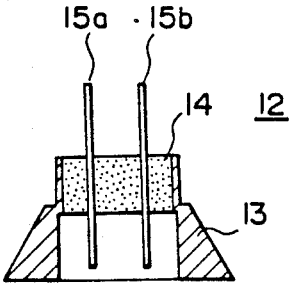
FIG. 8 is a sectional view of the anode button of FIG. 7.

FIGS. 1 and 2 show a TRINITRON (tradename) type cathoderay tube 1 according to an embodiment of the present invention. The tube body 2 of the cathoderay tube 1 is formed of a panel portion 3, funnel portion 4, and a neck portion 5, within which is mounted an electron gun 6. On the side toward the stem of the electron gun 6, there are mounted three cathodes 7R, 7G, and 7B corresponding to red (R), green (G), and blue (B) beams in an inline manner, and there are positioned sequentially ahead of the cathodes and coaxially with respect to the center axis a first grid $G_1$ which opposes the cathodes, a common second grid $G_2$, a third grid $G_3$, a fourth grid $G_4$, and a fifth grid $G_5$. In the stage succeeding the fifth grid $G_5$, there is provided a convergence means 8, which is formed of inner convergence plates 8*a*, 8*b* which vertically oppose each other with the aforesaid center axis in between and outer convergence plates 8*c*, 8*d* are mounted outwardly of the inner convergence plates 8*a*, 8*b* and oppose each other with the aforesaid center axis in between. Both of the inner convergence plates 8*a*, 8*b* are electrically and mechanically connected to the fifth grid $G_5$. The first grid $G_1$, the second grid $G_2$, and the third grid $G_3$ are provided with through holes formed therein for allowing the passing of electron beams 9R, 9G, and 9B which correspond to red, green, and blue and which are supplied from their respective cathodes 7R, 7G, and 7B. The third, fourth, and fifth grids $G_3$, $G_4$ and $G_5$ form a principal electron lens. The electron beams 9R, 9G, and 9B cross virtually in the center of the principal electron lens, and then the R (red) beam 9R and the B (blue) beam 9B which are located at both sides of the central beam 9G diverge. While the G (green) beam 9G in the center travels straight between the inner convergence plates 8*a*, 8*b*, the R beam 9R and the B beam 9B are deflected while traveling between the inner convergence plates 8*a*, 8*b* and the outer convergence plates 8*c*, 8*d* which face each other, respectively, and are caused to converge again at a point on the phosphor screen. So as to cause the deflection, the inner convergence plates 8*a*, 8*b* are supplied with an anode voltage HV through an anode button 12 by means of conductive elastic contact pieces 10 which are attached to the fifth grid $G_5$ and which have their free ends in contact with the inner conductive coating 11. The outer convergence plates 8*c*, 8*d* are individually supplied with respective voltages with convergence voltage supply means according to the present invention. The anode button for supplying such voltage is shown in FIGS. 7 and 8 and is formed such that two pins 15*a*, 15*b* which are formed of conductors supply the respective outer convergence plates 8*c*, 8*d* with the individual voltages and are mounted parallel to each other in the center of a shell 13 which is formed of a conductor material so as to supply the anode voltage HV, and which are insulated by duraglass (barium glass including alumina powder) 14. Also, the anode button 12 shown in FIGS. 9 and 10 can also be used which is formed such that a first pin 15*a* is formed as cylindrical conductor so as to supply one convergence plate 8*c* with the voltage and is mounted within the shell 13 which is formed of a conductor and is insulated therefrom by duraglass 14. A second pin 15*b* is formed of a conductor so as to supply the other convergence plate 8*d* with voltage and is mounted within the pin 15*a* and is insulated therefrom by dura-glass 14. An arrangement may also be provided wherein two anode buttons of a conventional type each of which have a conductor pin mounted within a shell and insulated therefrom by dura-glass are used and which are mounted on both the left and the right sides of the funnel portion 4 as shown in FIG. 11 so as to supply the outer convergence plates 8*c*, 8*d* with their respective voltages. In such arrangement, however, the construction of the conventional funnel portion 4 is required to be modified and it is also required that high voltage lead wires be laid along the periphery of the cathode-ray tube, so that there is a risk that electrical leakage will occur. Therefore, in actual practice, the two previously described types anode buttons 12 are preferable.

Incidentally, the shell 13 and pins 15*a*, 15*b* are made o a material such as 426 alloy, for example, and are provided with surface treatment of oxide coating.

The supplying of the voltages to each of the other convergence plates 8*c*, 8*d* from the anode button 12 is performed in the following manner.

Figure 12:
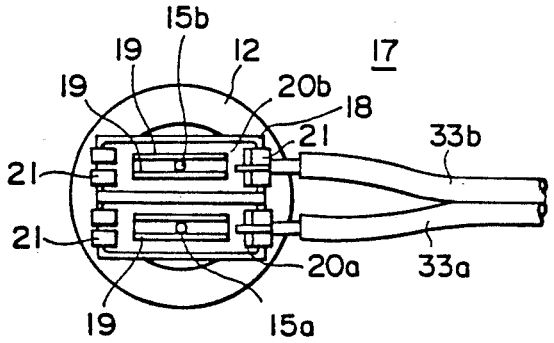
FIG. 12 is a plan view of a connector.
Figure 13:
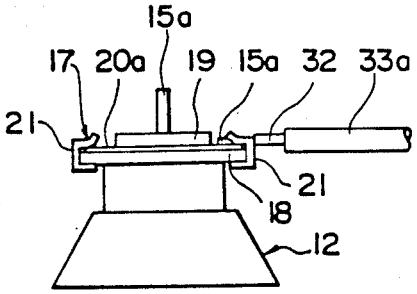
FIG. 13 is a side view of the connector of FIG. 12.

First, when using the anode button 12 shown in FIGS. 7 and 8, a connector 17 for connecting the two parallel pins 15*a*, 15*b* respectively to the lead wires 16*a*, 16*b* is formed as shown in FIGS. 12 and 13, such that metal pieces 20*a*, 20*b* are provided which have bent portions 19 which are capable of mating with the pins 15*a*, 15*b*, respectively, and are fixed by fastening members 21 to a ceramic board 18, in which through holes for the two pins 15*a*, 15*b* are formed. The lead wires 16*a*, 16*b* for supplying voltages to their respective outer convergence plates 8*c*, 8*d* are fixed to the metal pieces 20*a*, 20*b*, and thereby, electrical connections between the lead wires 16*a*, 16*b* and the pins 15*a*, 15*b* are achieved through the metal pieces 20*a*, 20*b*.

Figure 9:
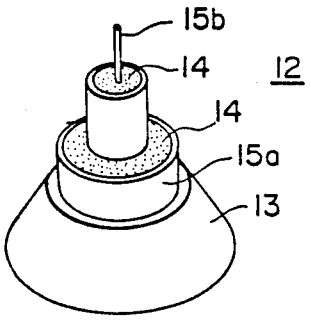
FIG. 9 is a perspective view of another anode button.
Figure 10:
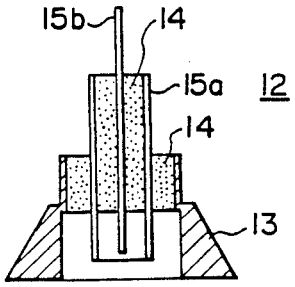
FIG. 10 is a sectional view of the anode button of FIG. 9.
Figure 11:
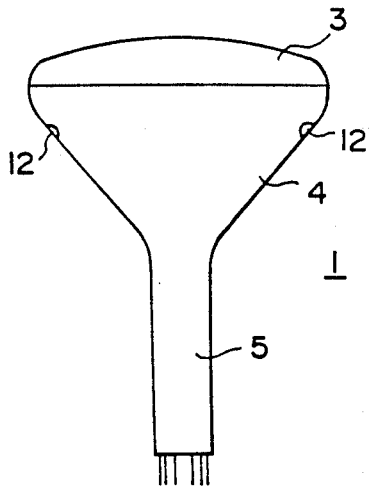
FIG. 11 is a drawing used for explaining another button arrangement.
Figure 14:
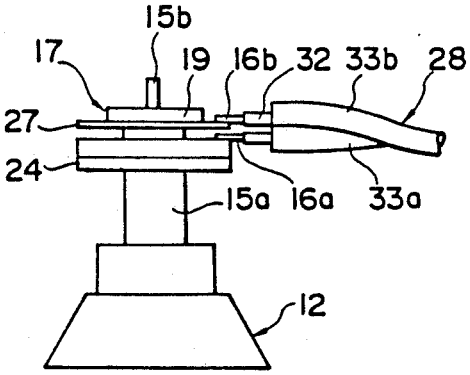
FIG. 14 is a side view of another connector.
Figure 15:
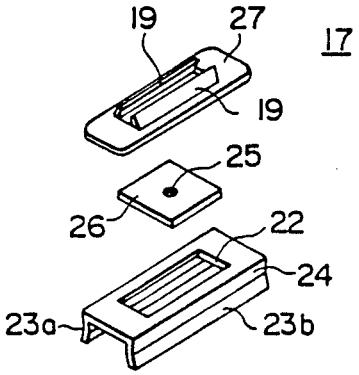
FIG. 15 is a perspective view of the connector of FIG. 14.
Figure 16:
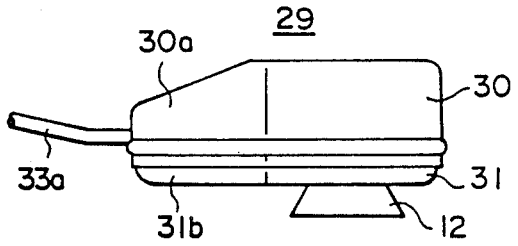
FIG. 16 is a side view of a shield member.
Figure 17:
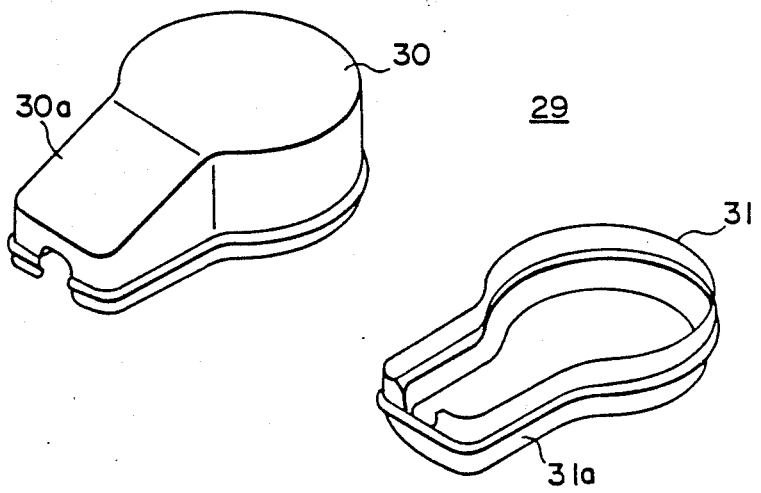
FIG. 17 is an exploded view in perspective of the shield member.
Figure 18:
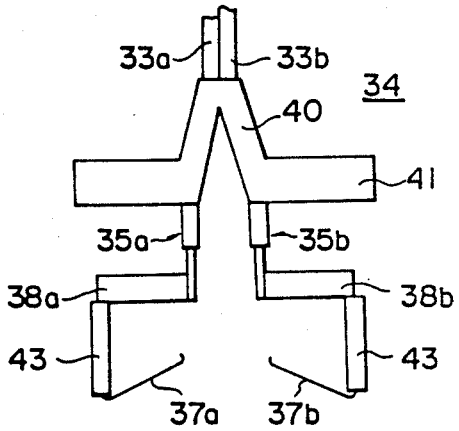
FIG. 18 is a front view of a connection means.
Figure 19:
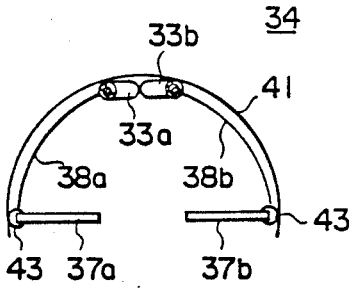
FIG. 19 is a plan view of the connection means.
Figure 20:
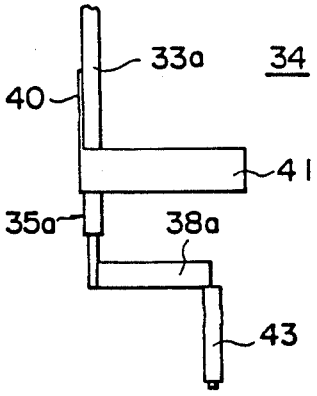
FIG. 20 is a side view of the connection means.
Figure 21:
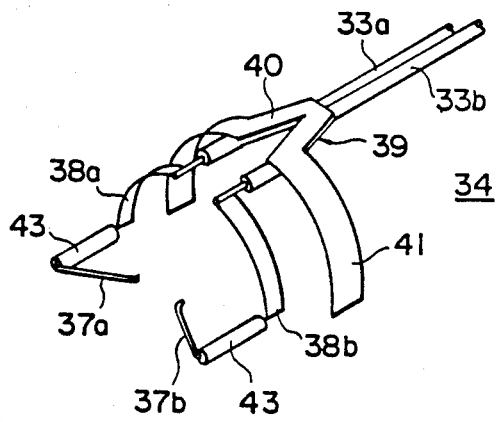
FIG. 21 is a perspective view of the connection means.

Then, in the case of the anode button 12 shown in FIGS. 9 and 10, a connector 17 for connecting the two coaxial pins 15*a*, 15*b* with the lead wires 16*a*, 16*b* is shown in FIGS. 14 and 15 and is formed of a lower metal piece 24 which has a through hole 22 formed therein which is large enough so as not come in contact with the central pin 15*b* and which has both of its side portions 23*a*, 23*b* folded so that they make contact with the periphery of the outer pin 15*a* and an upper metal piece 27 which is fixed over the lower metal piece and has bent portions 19 capable of mating with the central pin 15*b*. A ceramic plate 26 has a through hole so as to allow the central pin 15 to pass therethrough is mounted in between. The lead wires 16*a*, 16*b* for supplying voltages to their respective outer convergence plates 8*c*, 8*d* are welded to the upper metal piece 27 and to the lower metal piece 24, and thus, electrical connections between the lead wires 16*a*, 16*b* and the pins 15*a*, 15*b* are achieved through the metal pieces 27, 24. In the case where this type of connector 17 is used, the lead wires 16*a*, 16*b* are connected so they extend vertically, and therefore, they must be twisted through an angle of 90° so they can be laid along the inside area of the funnel portion 4. It is preferable that the twisted portion 28 be provided within 25 mm of the pins 15*a*, 15*b*.

There is provided a shield member 29 as shown in FIGS. 1, 2, 16 and 17 for enclosing therein the anode button 12 and the connector 17 within the funnel portion 4. The shield member 29 is made up of an upper member 30 and a lower member 31, the member 29 is adapted to fit over the member 31, and since, in the case where the connected ends of the lead wires 16*a*, 16*b* extend vertically, the twisted portion 28 must also be accommodated by the shield member 29, and both of the members 30, 31 are provided with extending portions 30*a*, 31*a* in the direction of the lead wires 16*a*, 16*b*. The shield member 29 is especially provided so as to prevent the occurrence of a short circuit due to a getter which is used at the time of gettering of the tube.

Figure 22:
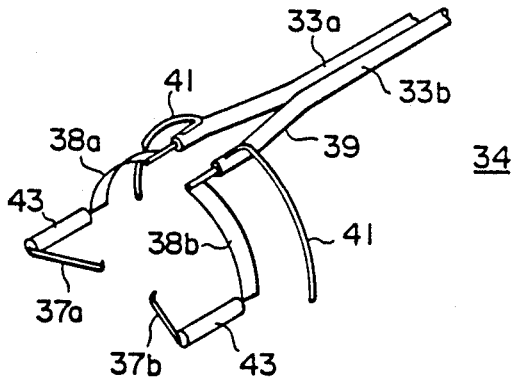
FIG. 22 is a perspective view of another form of a connection means.

Then, the lead wires 16*a*, 16*b* which are connected to the anode button 12 are led to the neck portion 5 along the inside area of the funnel portion 4, and there, they are connected to their respective outer convergence plates 8*c*, 8*d* with the below described means. The lead wires 16*a*, 16*b* are covered by an insulating material 32 and the lead wires 16*a*, 16*b* with the insulating material 32 thereon are inserted into conductive pipes 33*a*, 33*b*. The connection means 34 for connecting the lead wires 16*a*, 16*b* to their respective outer convergence plates 8*a*, 8*b* is constructed, as shown in FIGS. 1, 2 and FIGS. 18–21, such that the end portions 35*a*, 35*b* of the conductive pipes 33*a*, 33*b* are separated from each other so as to form a V so that bead glass 36 of the electron gun 6 will not touch the connection means 34 and the end portions 35*a*, 35*b* of the V thus formed is opened at least as wide as the width of the bead glass 36, for example, approximately 12 mm and the lead wires 16*a*, 16*b* which are led out of the end portions 35*a*, 35*b* are welded to elastic sheet members 38*a*, 38*b* which have conductive elastic contact pieces 37*a*, 37*b* formed integral therewith. Reference numeral 43 denotes insulating pipes. There is also provided a symmetrical support spring 41 which has a base portion 40 which is welded to the V-formed portion 39 of the two conductive pipes 33*a*, 33*b*. The support spring 41 is provided so as to rigidly support the lead wires 16*a*, 16*b* because they are positioned in contact with the inside conductive coating 11 of the neck portion 5. By applying the anode voltage HV to the conductive pipes 33*a*, 33*b* through the inside conductive coating 11 and the support spring 41, disturbance of the electrical field due to the mounting of the lead wires 16*a*, 16*b* to which are applied the convergence voltage CV on the inside of the funnel portion 4 can be avoided. The support spring 41 can be provided by punching it out of a conductive sheet such that its base portion 40 is not separated. The support spring 41 can also be provided, as shown in FIG. 22, by having two linear conductive elastic members which are welded to the conductive pipes 33*a*, 33*b* and which correspond to the lead wires 16*a*, 16*b* at the V-formed portion 39. By the use of the above mentioned support spring 41, an effect is obtained such that generation of eddy current therein due to the magnetic field from the deflection yoke is less likely as compared with the case where the support spring of the conventional structure is used.

According to the present invention, since the voltages to be applied to each of the outer convergence plates in the convergence plate assembly within the electron gun can be individually adjusted, the horizontal misconvergence at the center portion and peripheral portion of the screen can be eliminated. Hence, it follows only that care is required to be taken for vertical misconvergence in connection with the deflection yokes, and the freedom during the designing the deflection yoke is increased and ease of designing the deflection yoke so as to produce smaller spot distortion becomes possible. Further, since the need for use of six-pole magnets or the like for correction of the horizontal misconvergence is eliminated, the prior problem of deterioration of form of the spot is solved.

According to the present invention, the anode button of optimum structure for correcting horizontal misconvergence can be provided.

According to the present invention, the convergence voltage supply means of optimum structure in the cathode-ray tube for correcting the horizontal misconvergence can be provided.

Although the invention has been described with respect to preferred embodiments, it is not to be so limited as changes and modifications can be made which are within the full intended scope of the invention as defined by the appended claims.

We claim as our invention:

1. A cathode ray tube which includes an evacuated envelope with a neck portion at one end in which multiple beam electron guns which generate multiple beams are mounted comprising first, second, third, fourth and fifth grids mounted in said neck portion of said evacuated envelope is a serial spaced arrangement, a first pair of convergence plates mounted on either side of the electron beams in said neck portion and electrically connected to said fifth grid, a second pair of convergence plates mounted on either side of said first pair of convergence plates in said neck portion, an anode button mounted in a funnel portion of said cathode ray tube and extends through the wall of said funnel portion and formed with first and second electrical contacts, said first and second pairs of convergence plates mounted between said fifth grid and a panel portion of said evacuated envelope, a first insulated electrical conductor which extends from one of said second pair of convergence plates to said first electrical contact, and a second insulated electrical conductor which extends from a second one of said second pair of convergence plates to said second electrical contact, a connection means for connecting said first and second insulated electrical conductors to said one and said second of said second pair of convergence plates comprising a pair of curved elastic contact pieces connected respectively to said first and second electrical conductors, and a first straight contact piece electrically connected to a first one of said pair of curved elastic contact pieces and engageable with said one of said second pair of convergence plates and a second straight contact piece electrically connected to a second one of said pair of curved elastic contact pieces and engageable with second of said second pair of convergence plates.

2. A cathode ray tube according to claim 1 wherein said first and second electrical conductors have a V-shaped insulated portion and including an electrical conducting V-shaped symmetrical supporting spring formed with two ends and which is connected to said V-shaped insulating portion of said first and second electrical conductors and which has curved extending legs which engage a conductive coating formed on the inside surface of said neck portion so as to rigidly support said first and second insulated electrical conductors.

* * * * *